US006589666B1

(12) United States Patent
Herder et al.

(10) Patent No.: US 6,589,666 B1
(45) Date of Patent: Jul. 8, 2003

(54) LOAD-BEARING STRUCTURE

(75) Inventors: Peter Herder, Bromma (SE); Per Johan Gustafsson, Lund (SE)

(73) Assignee: Akzo Nobel N.V., Arnem (NL)

( * ) Notice: Subject to any disclaimer, the term of this patent is extended or adjusted under 35 U.S.C. 154(b) by 0 days.

(21) Appl. No.: 09/857,439

(22) PCT Filed: Nov. 25, 1999

(86) PCT No.: PCT/SE99/02191

§ 371 (c)(1),
(2), (4) Date: Sep. 26, 2001

(87) PCT Pub. No.: WO00/32945

PCT Pub. Date: Jun. 8, 2000

(30) Foreign Application Priority Data

Dec. 3, 1998 (EP) ..... 98850186

(51) Int. Cl.[7] ..... B32B 21/04

(52) U.S. Cl. ..... 428/537.1; 428/465; 428/492; 428/496; 156/338

(58) Field of Search ..... 428/537.1, 492, 428/496, 465; 156/338

(56) References Cited

U.S. PATENT DOCUMENTS

| | | | | |
|---|---|---|---|---|
| RE31,960 E | * | 7/1985 | Phillips | 428/418 |
| 5,103,614 A | * | 4/1992 | Kawaguchi | 52/392 |
| 6,051,301 A | * | 4/2000 | Tingley | 428/106 |

* cited by examiner

*Primary Examiner*—Leszek Kiliman
(74) *Attorney, Agent, or Firm*—David J. Serbin

(57) ABSTRACT

Load-bearing structure comprising at least two layers (10, 20, 155, 160, 300, 310) joined by a bond line having a thickness of t mm, a shear strength of T N/mm$^2$, and comprising a sheet (30, 130, 320) made of an elastic material having a shear modulus of G N/mm$^2$, whereby $tT^2/G$ is at least 5 N/mm. A method for producing such a load-bearing structure in which a sheet (30, 130, 320) of rubber is treated with an oxidant, excess oxidant is removed, whereafter the sheet is glued between the two layers (10, 20, 155, 160, 300, 310).

16 Claims, 3 Drawing Sheets

LOAD-BEARING STRUCTURE

The present invention relates to load-bearing structures comprising two or more layers, preferably elongate or oblong layers, and in particular glued structural members.

Load-bearing structures occur in various shapes, sizes and connections. They are practically indispensable in construction activities, either as parts of the construction itself, or as aids for the construction work (e.g. scaffolds), or both. They are also frequently used in smaller constructions such as furniture, like for instance chairs, tables and sofas. Load-bearing structures also constitute parts of various tools such as axes and sledges, in the form of handles, but also as power-transmitting or supportive parts of machines and apparatuses. As the word implies, the primary purpose of a "load-bearing structure" is to carry loads, give support to other parts in a construction, and/or to transmit dynamic forces in a construction or a machine; thus other properties, such as for instance vibration or sound insulating properties, if any, may be considered to be of minor significance with regard to the present structure. Considering a floor, for instance, it is the floor-joists that constitute the load-bearing structures, whereas the flooring, the purpose of which is to provide for a surface to walk on and to place objects on, to be decorative, and to provide for insulation from cold and noise, does not constitute such a structure.

Depending on the specific use intended for the load-bearing structure it may be made of different materials, such as metal, wood or plastic, or combinations thereof. In many instances such structures are made of two or more layers. As a matter of fact, a load-bearing structure may in some cases be made stronger if split into two or more layers and then rejoined by means of some suitable adhesive, as has been shown by P. J. Gustafsson in "Analysis of generalized Volkersen-joints in terms of non-linear fracture mechanics" (Mechanical Behaviour of Adhesive Joints, 1987, pp. 323–338), hereby incorporated by reference.

Frequently, load-bearing structures of the latter kind are so-called glued structural members, especially glued-laminated timbers, extensively discussed in chapter 10 of "Wood Handbook: Wood as an engineering material" (U.S. Forest Laboratory, 1974, USDA Agr. Handb. 72, rev), incorporated herein by reference. The strength of such a laminated product depends, according to said "Wood Handbook", upon the quality of the adhesive joints. The joints may in principle be divided into two groups, ductile and brittle, although in practice most joints will be found in the transition region between those two extremes. The concept of ductile and brittle joints has been extensively discussed by P. J. Gustafsson (see supra). Ductile characteristics are often preferred to brittle, e.g. for joints subjected to stress concentrations (described e.g. in McGraw-Hill encyclopaedia of Science and Technology, 1960, Vol. 3, page 185), joints big in size, joints subjected to dynamic loads, especially impact loads, and joints subjected to forces from shrinkage or swelling of joined wooden layers making up load-bearing structures. If it is not desirable—or possible—to modify such joint parameters as size, geometry, or properties relating to the layers making up the load-bearing structure, the only option left for regulating the brittleness/ductileness properties of the joint is to change the parameters relating to the bond line. H. Wernerson and P. J. Gustafsson in "The complete stress-slip curve of wood-adhesives in pure shear" (Mechanical Behaviour of Adhesive Joints, 1987, pp. 139–150) teach that the question whether a bond line will be brittle or ductile may generally be determined by the relation between the peak shear stress and the fracture energy of the bond line: thus a low peak shear stress, in relation to the fracture energy, indicates a ductile performance, and vice versa. As a low peak shear stress for quite obvious reasons is not desirable, the fracture energy has to be increased in order to obtain a ductile joint.

H. Wernerson and P. J. Gustafsson (see supra) have performed a number of tests regarding the performance of bond lines consisting of PVAc, polyurethane and resorcinol/phenol adhesives between wooe adherents; the fracture energy of the bond lines ranges from about 0.4 to 2.4 $kNm/m^2$. A similar test is described in P. J. Gustafsson (see supra), in which the strength of joints with bond lines of polyurethane and resorcinol/phenol adhesives is compared with the strength of solid wood; the polyurethane bond line gave the highest strength, 2.1 MPa.

Takeshi Sadoh et al have studied the bending properties of horizontally veneer-laminated beams with glue-layers of various kinds, including an elastomeric adhesive, and compared said properties with those of vertically veneer-laminated beams, considered to be equivalent to solid wood beam ("Veneer laminates with elastomeric glue-layers. I. Rending properties of veneer-laminted beams", Mokuzai Gakkaishi, 1978, 24(5), page 294–8).

Accordingly, all indications in the prior art relating to enhanced ductility of joints in load-bearing structures due to increased fracture energy of the bond lines are directed to bond lines consisting of glue, and n thing but glue.

The prior art further indicate a number of other laminated products with glue lines of elastomeric adhesives, and even laminates comprising elastomeric sheets, e.g. in U.S. Pat. No. 5,103,614, JP 1244838 and JP 61-261048; however, all of these suggestions relate to sound insulating and vibration damping properties useful in e.g. flooring material; said properties are due to a hysteresis phenomenon associated with the elastomeric materials used, which phenomenon basically consists of a transformation of the mechanical energy of the sound or vibrational energy into thermal energy.

The problem to be solved by the present invention is to provide a load-bearing structure of the kind referred to in the introduction having joints with enhanced ductility when compared to prior art load-bearing structures of similar kind and size.

This problem is solved by the present invention, which relates to a load-bearing structure of the kind referred to in the introduction and has the additional features as defined in the characterising clause of appended Claim 1. More specifically the load-bearing structure according to the present invention comprises two or more layers, at least two of which are joined by a bond line, that has a thickness of t mm, a shear strength of T $N/mm^2$, and which comprises a sheet made of an elastic material, which has a shear modulus of G $N/mm^2$, whereby $$\frac{tT^2}{G}$$

is at least about 5 N/mm, preferably at least about 10 N/mm, and most preferably at least about 50 N/mm. If the structure comprises more than two layers they may all be joined by sheets of the present kind, but it may alternatively contain only one such sheet while the layers otherwise are joined by means of conventional bond lines.

Bond lines of the kind present in load-bearing structures of the instant invention, i.e. the sheet plus adhesive, have shown to have about twice the load-bearing capacity of bond lines according to prior art, even though the bond line according to the invention was applied to a comparably smaller joint area.

Apart from solving the stated problem, the present invention provides a number of advantages. The present invention creates opportunities for a number of combinations of sheet material, sheet thickness, and adhesives, providing for great freedom of choice with regard to joint properties. The joint may for instance be established very quickly, as a prefabricated sheet can be adhered by means of a suitable fast drying or fast curing glue or adhesive. The shear strength of the adhesive used in the inventive bond line does not have to be as high as for those used in prior art bond lines (which usually have a strength of about 10–15 MPa). Furthermore the bond line thickness, which of course is a significant joint parameter, may be chosen arbitrarily as the sheet used in the bond line can be prefabricated with any thickness, which would not be practicable if only elastomeric adhesives were to be used in a bond line according to prior art.

Any material having the properties stated in Claim 1 may of course be used in the inventive load-bearing structure, but preferably the sheet will be made of some conventional elastomeric material such as a natural or synthetic rubber, or a mixture thereof. A preferred group of rubbers is nitrile rubbers.

The shear strength of the elastic material is suitably no less than 2 MPa, and the thickness of the sheet is normally about 0.1–5 mm, preferably about 0.2–3 mm.

The layers making up the load-bearing structure may be made of any suitable material used in the art, such as for instance wood, metal, plastics, ceramics, or combinations thereof. According to one embodiment at least one of the layers of the load-bearing structure is made of wood. In another embodiment at least one of said layers is made of metal. Commonly the present structure is made mainly of wooden layers, such as for instance in glued-laminated timbers and other similar wood based load-bearing structures.

The present invention also relates to the use of a structure as described above as a load-bearing structure.

Furthermore the present invention relates to a method for producing a load-bearing structure of the present kind, i.e. as described above, by treating a sheet of natural or synthetic rubber, or a mixture thereof, having suitable shape and size with an oxidant, preferably substantially concentrated $H_2SO_4$, removing excess oxidant, and then gluing the sheet between two layers. The treatment with the oxidant should be kept for a period of time sufficiently long to oxidise the sheet to such a degree that the adhesion between the sheet and the glue is satisfying, while on the other hand it should be sufficiently short to avoid a too thick oxide coating, which could make the sheet surface brittle. Preferably the treatment with oxidant is kept for a period of about 10–25 seconds, particularly 13–20 seconds. The treated sheet preferably comprises nitrile rubber.

BRIEF DESCRIPTION OF THE FIGURES

The present invention will now be described in more detail by means of the appended drawings, in which.

DETAILED DESCRIPTION OF THE FIGURES

Figure 1:
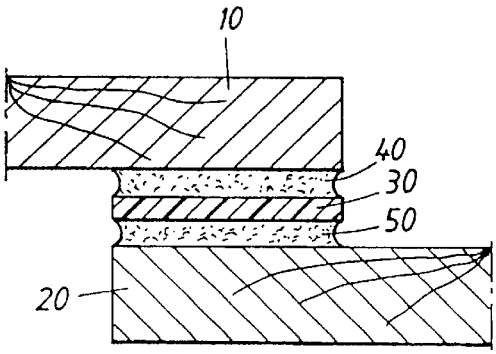
FIG. 1 is a schematic illustration of a joint between two wooden layers in a load-bearing structure according to the present invention.

In FIG. 1, two layers 10 and 20 are joined into a load-bearing structure by a bond line made of a sheet 30 of elastic material, which is adhered to said layers 10, 20 by means of glue layers 40 and 50.

Figure 2:
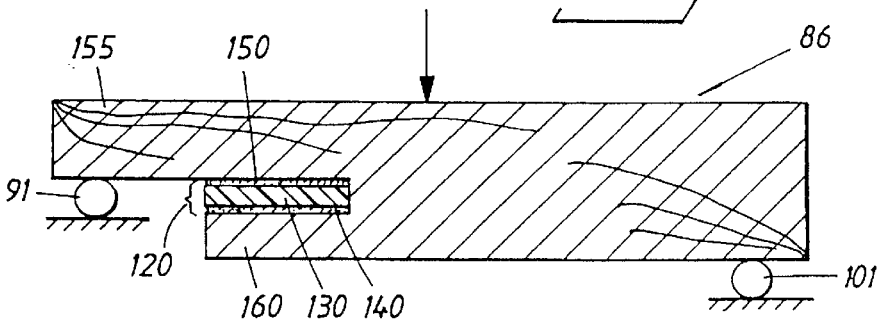
FIG. 2 is a schematic illustration of a notched load-bearing beam according to the present invention.

In FIG. 2 a beam 86 rests on two supports 91 and 101, positioned at the ends of said beam. The end resting on support 91 is notched, causing a stress concentration in the beam. In order to prevent cracking the beam has been fitted with a bond line 120 in the critical notched portion. The bond line, which at the same time demarcates and joins the two layers 155, 160, is made of a sheet 130 of an elastic material and two glue layers 140, 150. In an alternative embodiment, the bond line may range along the entire length of the beam. The beam 86 is thus a load-bearing structure according to the present invention.

Figure 3:
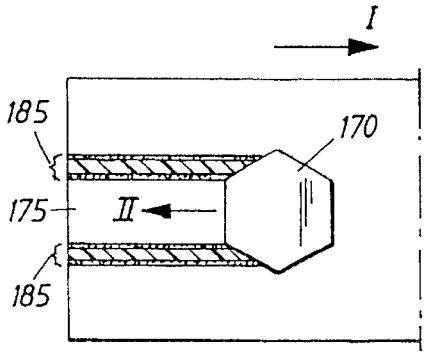
FIGS. 3 and 4 are illustrations of how cracks in wooden load-bearing structures may be avoided alternatively how such structures may be mended by means of the present invention.

FIG. 3 shows one end of beam fixed by a screw bolt 170. The beam is subject to a load indicated by arrow I. In reaction to load I, the bolt exerts a force II on the beam portion 175, causing stress concentrations in the beam. In order to prevent cracking the beam has been reinforced by means of bond lines 185, each made of a sheet of elastic material and two glue layers, resulting in a load-bearing structure according to the present invention.

Figure 4:
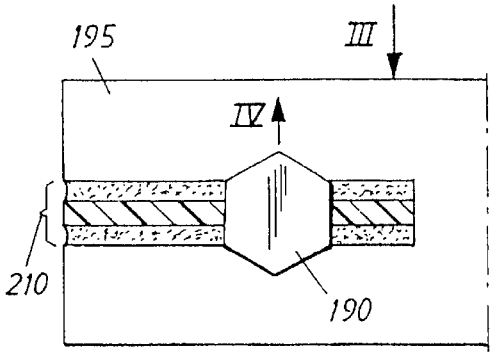

FIG. 4 shows one end of a beam fixed by a bolt 190. The beam is subject to a load III. The bolt exerts a reactive force IV on the upper layer 195 of the beam causing stress concentrations in the beam. In order to prevent cracking the beam has been reinforced by means of a bond line 210 made of a sheet of elastic material and two glue layers, resulting in a load-bearing structure according to the present invention.

Figure 5:
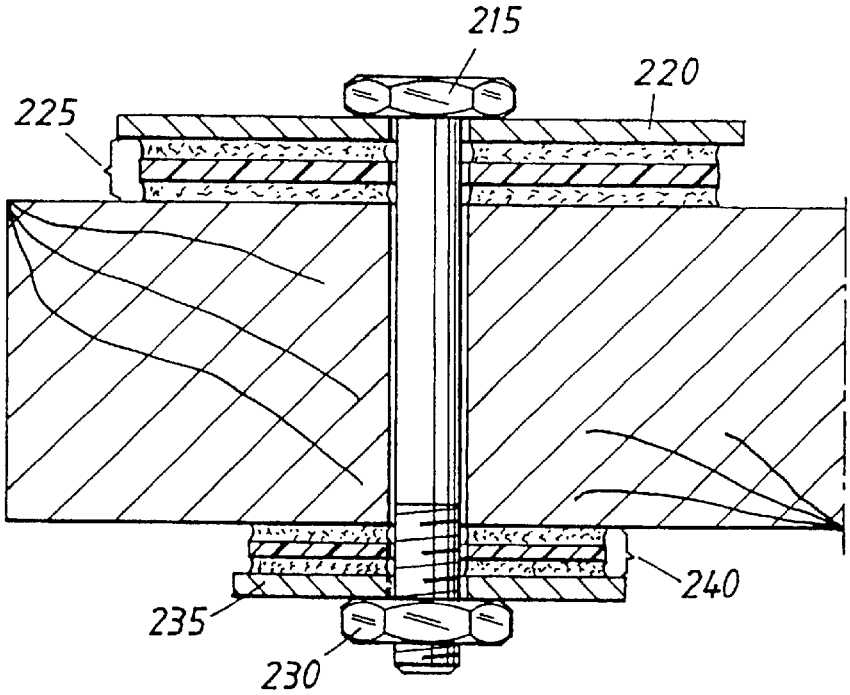
FIG. 5 illustrates a screw bolt joint in a wooden beam, constituting an embodiment of the present invention.

FIG. 5 shows a screw bolt joint of a kind that may be used in order to avoid stress concentrations of the kind indicated by FIGS. 3 and 4. It may also be used instead of, or in combination with, any of the solutions set forth by FIG. 3 or 4 in order to reinforce or mend an already cracked beam. The screw bolt joint comprises a rather big metal washer 220, which is joined with the beam by means of a bond line 225 made of a sheet of elastic material and two glue layers. On the other side of the beam, another metal washer 235 is joined with the beam by means of a bond line 240, also made of a sheet of an elastic material and two glue layers. The bolt head 215 and the bolt nut 230 exerts pressure on washer 220 and 235, respectively, which in turn transfer that pressure over the entire interfaces between the bond lines and the beam, thus causing the forces exerted by the screw bolt to act over a much bigger surface than if no such bond line were used. As a consequence of this, stress concentrations are avoided or at least significantly reduced.

Figure 6:
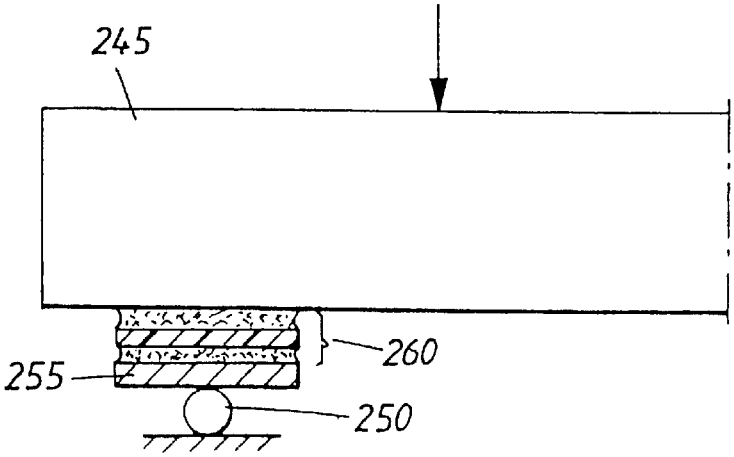
FIG. 6 shows a supported end portion of a wooden beam constituting another embodiment of the present invention.

FIG. 6 shows one end of a wooden beam 245 resting on a support 250. In order to avoid dints or even more serious damages on the beam, caused by the high pressure exerted by the support 250 due to the small interface between the support and the beam, a sheet 255 of metal has been joined, by means of a bond line 260 according to the invention, with the beam. The force exerted by the support 250 is thus distributed to the beam over the interface between the bond line 260 and the beam, greatly reducing the stress concentrations in the wooden surface. The joint between the sheet 255 and the beam 245 is very much less sensitive to changes in the wood such as drying, swelling or shrinking, than would have been the case if a bond line according to prior art had been utilised.

Figure 7:
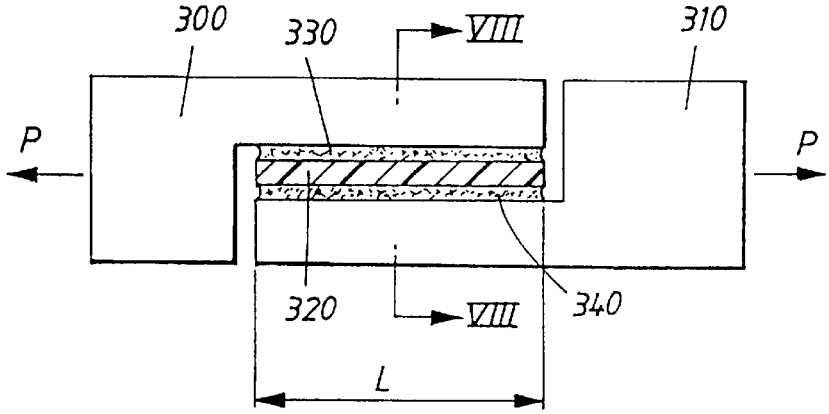
FIG. 7 schematically shows an inventive load bearing structure used in tests presented below.
Figure 8:
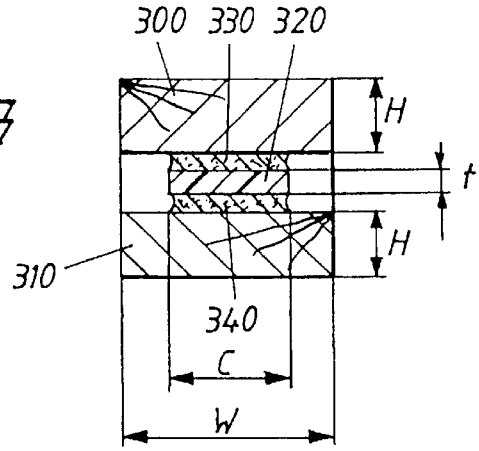
FIG. 8 is a cross-sectional view along line VIII—VIII in FIG. 7.

FIGS. 7 and 8 will be discussed in connection with the Examples presented below.

Figure 9:
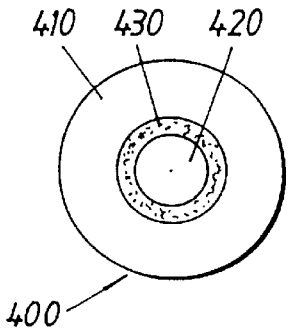
FIG. 9 is an end-view of a specific embodiment of the present invention, namely a load-bearing structure in form of a round pole.
Figure 10:
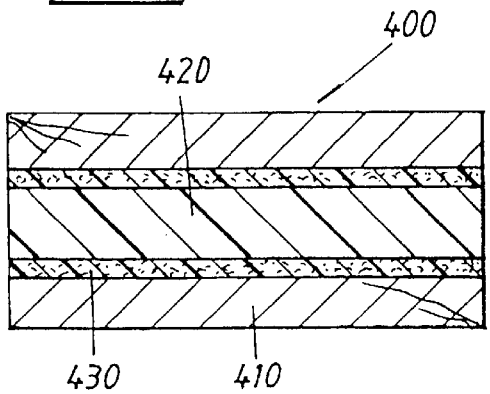
FIG. 10 is a cross-sectional view along the pole illustrated in FIG. 9.

FIGS. 9 and 10 illustrates a load-bearing pole 400 consisting of an outer cylindrical element 410, an inner cylindrical element 420, and an intermediate bond line 430 according to the present invention. It should be understood that the profile of said elements does not have to be cylindrical, but could just as well be squared, rectangular, oval etc.

The following Examples are all merely intended to illustrate the present invention, and should not be considered to be limiting the scope of the invention.

EXAMPLE 1

Experimental load-bearing structures as illustrated by FIGS. 7 and 8 were used in these experiments. The structures were made of two wooden layers 300, 310 adhered by means of two glue layers 330, 340 to opposite sides of an sheet 320 made of a elastic material. The Modulus of Elasticity (MOE) of the wood was about 13 GPa.

The elastic material used was natural rubber, below abbreviated as NR. In order to provide sufficient adhesion between the rubber and the glue, the rubber surface was treated with concentrated sulphuric acid for 17 seconds and was then washed with water. Under the conditions prevailing for this example, acid treatments longer than 20 seconds showed to cause a thick oxide layer, giving the rubber a brittle surface, whereas treatments shorter than 13 seconds did not provide sufficient oxidation of the rubber surface, thus causing poor adhesion.

After said surface treatment, the rubber sheets were glued to the wooden layers by means of a two component polyurethane adhesive comprising 100 parts by weight of a polyurethane glue Casco® 1899 and 22 parts by weight of corresponding hardener Casco® 1821, which is a isocyanate based hardener.

The width W of the wooden layers was 30 mm, and the height H of each layer was, at the joint, 20 mm. The rubber sheet had a thickness of 1.0 mm.

Two inventive structures were prepared, as well as two comparative structures according to prior art, in which no rubber sheets were used; the bond lines in said comparative structures were made of conventional resorcinol/phenol adhesive, below abbreviated as R/P.

All four structures were subjected to shearing forces until failure, and the shear force at failure, $P_f$, was registered for each one of the structures; these values, as well as the dimensions of the joints, are presented in Table I below.

TABLE I

| No. | bond line | Joint length mm | Joint width mm | Joint area mm$^2$ | $P_f$ kN | remarks |
|---|---|---|---|---|---|---|
| 1 | NR | 300 | 8.8 | 2640 | 5.7 | failure in wood |
| 2 | NR | 300 | 8.5 | 2550 | 8.7 | joint failure |
| 3 | R/P | 400 | 10.0 | 4000 | 3.8 | " |
| 4 | R/P | 400 | 10.0 | 4000 | 4.2 | " |

Although acting on a smaller bond line surface, the joints of the inventive structures had about twice the load-bearing capacity of a conventional load-bearing structure. It can be estimated that $P_f$ in test no. 2 would have been 10.9 kN if the joint area had been 4000 mm$^2$.

EXAMPLE 2

As in Example 1 experimental load-bearing structures as illustrated by FIGS. 7 and 8 were used in these experiments. The structures were made of two wooden layers 300, 310 adhered by means of two glue layers 330, 340 to opposite sides of an sheet 320 made of a elastic material. The Modulus of Elasticity (MOE) of the wood was about 13 GPa.

The elastic materials used were NR and nitrile rubber, below abbreviated NIR. In order to provide sufficient adhesion between the rubber and the glue, the rubber surfaces were treated with concentrated sulphuric acid in the same way as in Example 1.

After said surface treatment, the rubber sheets were glued to the wooden layers by means of the same kind of adhesive as in Example 1.

The width W and height H of the wooden layers were the same as in Example 1. The rubber sheet thickness t varied from one experiment to another and is indicated in Table II below.

Four inventive structures were prepared, as well as two comparative structures according to prior art, in which the bond lines were made of conventional R/P adhesive, just as in Example 1. All the six structures were subjected to shearing forces until failure, and the $P_f$ value was registered for each one of the structures; these values, as well as the dimensions of the joints, are presented in Table II below.

TABLE II

| No. | bond line | t mm | Joint length mm | Joint width mm | Joint area $mm^2$ | $P_f$kN | Shear stress at failure MPa | remarks |
|---|---|---|---|---|---|---|---|---|
| 1 | R/P | — | 400 | 10.0 | 4000 | 3.8 | 0.9 | joint failure |
| 2 | R/P | — | 400 | 10.0 | 4000 | 4.2 | 1.1 | joint failure |
| 3 | NR | 1.0 | 300 | 8.8 | 2640 | 5.7 | 2.2 | failure in wood |
| 4 | NR | 1.0 | 300 | 8.5 | 2550 | 8.7 | 3.4 | failure between rubber and wood |
| 5 | NIR | 1.0 | 300 | 10.1 | 3030 | 10.5 | >3.5 | see Note |
| 6 | NIR | 0.5 | 300 | 10.0 | 3000 | 6.9 | 2.3 | failure in wood |

Note:
In test no. 5 the attachment between the experimental structure and the test equipment was broken.
From these results it is even more evident that the strength properties of the inventive structure surpass those of prior art structures.

What is claimed is:

1. Load-bearing structure comprising two or more layers, wherein at least two of the layers are joined by a bond line that has a thickness of t mm, a shear strength of T $N/mm^2$, and which comprises a sheet made of an elastic material, which has a shear modulus of G $N/mm^2$, whereby $$\frac{tT^2}{G}$$

is at least 5 N/mm.

2. Load-bearing structure according to claim 1, wherein $$\frac{tT^2}{G}$$

is at least 50 N/mm.

3. Load-bearing structure according to claim 1, wherein the sheet is made of an essentially elastomeric material.

4. Load-bearing structure according to claim 3, wherein the elastomeric material is rubber.

5. Load-bearing structure according to claim 1, wherein the shear strength of the elastic material is greater than about 2 Mpa.

6. Load-bearing structure according to claim 1, wherein at least one of the layers adhered to the elastic material is made of wood.

7. Load-bearing structure according to claim 1, wherein at least one of the layers is made of metal.

8. Load-bearing structure according to claim 1, wherein the structure is glue-laminated timber.

9. Method for producing a load-bearing structure according to claim 3, wherein a sheet of rubber is treated with an oxidant, excess oxidant is removed, whereafter the sheet is glued between two layers.

10. Method according to claim 9, wherein the sheet is treated with the oxidant for about 10–25 seconds.

11. Load-bearing structure comprising two or more layers, wherein at least two of the layers are joined by a bond line that has a thickness of t mm, a shear strength of T $N/mm^2$, and which comprises a sheet made of an essentially elastomeric material, which has a shear modulus of G $N/mm^2$, whereby $$\frac{tT^2}{G}$$

is at least 5 N/mm and at least one of the layers adhered to the elastomeric material is made of wood.

12. Load-bearing structure according to claim 11, wherein $$\frac{tT^2}{G}$$

is at least 50 N/mm.

13. Load-bearing structure according to claim 11, wherein the elastomeric material is rubber.

14. Load-bearing structure according to claim 11, wherein the shear strength of the elastic material is greater than about 2 MPa.

15. Load-bearing structure according to claim 11, wherein at least one of the layers is made of metal.

16. Load-bearing structure according to claim 11, wherein the structure is glue-laminated timber.

* * * * *